US005454492A

United States Patent [19]

Hunter et al.

[11] Patent Number: 5,454,492

[45] Date of Patent: Oct. 3, 1995

[54] BOTTLE COVER FOR A WATER DISPENSER

[76] Inventors: Lionel Hunter, 729 Jones St., Apt. 307, San Francisco, Calif. 94109; Byron Cobb, 1017 Pinewood Ter., San Pablo, Calif. 94806

[21] Appl. No.: 216,062

[22] Filed: Mar. 22, 1994

[51] Int. Cl.[6] ..... B67D 5/06

[52] U.S. Cl. ..... 222/185.1; 222/192; 221/96; 150/154

[58] Field of Search ..... 222/185, 192, 222/156; 221/96; 40/310, 306; 150/154, 165, 901

[56] References Cited

U.S. PATENT DOCUMENTS

| | | | |
|---|---|---|---|
| D. 266,056 | 9/1982 | Lear | D9/444 |
| 2,356,399 | 8/1944 | Hansen | 40/306 |
| 3,434,629 | 3/1969 | Hooge et al. | 221/96 X |
| 4,514,995 | 5/1985 | Bourgo et al. . | |
| 4,834,250 | 5/1989 | Dumbeck et al. | 222/185 X |
| 4,895,418 | 1/1990 | Medellin et al. | 312/252 |
| 5,065,879 | 11/1991 | King | 150/901 X |
| 5,085,346 | 2/1992 | Wright | 222/156 X |

*Primary Examiner*—Gregory L. Huson

*Attorney, Agent, or Firm*—Haverstock & Associates

[57] ABSTRACT

A decorative cover is provided which easily fits over a water bottle mounted on a water dispenser. This cover provides a variably changeable decor that can fit different tastes and environments. Further, this cover includes accessory features such as a handle for easy removal of the cover, a cup dispenser, and a pouch for storing water delivery schedules, bills and the like. In one embodiment the cover is constructed of a loose fitting material and includes a top portion and a side portion. In an alternate embodiment the cover is constructed of a rigid material designed to stand on its own around the water bottle. In this embodiment the cover can include a top portion or can leave the water bottle exposed on the top. This rigid material can be foam rubber coated with plastic for writing and erasing messages or metallic for attaching messages by magnetic means. Both the loose-fitting and the rigid embodiments of the cover can be made with stragetically positioned viewing ports in them for determining the water level in the water bottle and allowing light to reach the interior of the water bottle. The viewing ports can be made from the absence of any material or can be constructed of a Nylon mesh material. The cover can also include an interior liner which is used to absorb moisture away from the water bottle.

20 Claims, 2 Drawing Sheets

BOTTLE COVER FOR A WATER DISPENSER

FIELD OF THE INVENTION

This invention relates to water dispensing systems. More particularly, this invention relates to a cover for water bottles that are mounted on water dispensers.

BACKGROUND OF THE INVENTION

Drinking water for the home or office is generally stored in bottles, and dispensed by unsealing a bottle and inverting it onto a water dispenser. Water dispensers are usually metal, ceramic or plastic devices, depending upon their size; some are free standing and others are countertop models. Water dispensers generally have an interior storage chamber for the water, an opening on top of the dispenser for receiving an inverted water bottle, and means for dispensing the water from the chamber to the user. When a bottle is inverted onto the dispenser, the water flows into the interior storage chamber. In some dispensers, the storage chamber can chill or heat the water; others dispense the water at room temperature.

Water dispenser bottles are either round or angular in shape, and are usually made of clear or opaque glass or plastic so that the water level can be viewed. Although the bottles are designed to be useful, these characteristics make the appearance of a water dispenser at best a utilitarian and somewhat unattractive addition to the home or office environment.

Several covers for water dispenser bottles are described in the prior art. A water cooler bottle cover for circular bottles is illustrated in Design Pat. No. 266,056 to Lear. The Lear cover appears to slide onto and completely enclose the bottle. However, this cover does not allow the user to ascertain the amount of water remaining in the bottle.

Bourgo et al. U.S. Pat. No. 4,514,995 discloses a knit cover for beverage containers that has inherent heat insulating properties. However, such a cover is undesirable for use with water dispenser bottles because modern water dispensers only cool (or heat) the water once it is inside the dispenser chamber, rather than in the bottle itself, thus rendering the heat insulating properties of the water bottle cover useless. Furthermore, a cover with such insulating properties would tend to accumulate moisture from sweating and possibly contribute to the growth of bacteria which may lead to contamination of the drinking water itself.

Dumbeck et al. U.S. Pat. No. 4,834,250 discloses a decorative protective hood for water dispensers. However, the hood is designed to tightly hug the water bottle to protect the bottle from scratching and to contain the glass fragments should breakage occur. Since most water bottles are now constructed of plastic due to weight and safety considerations, this feature is no longer particularly useful. Furthermore, because of its form-fitting nature, the hood requires a longitudinal seam which extends vertically down the back portion and ends with a manually openable and resealable flap. Finally, the hood of Dumbeck does not teach means for attaching accessory features.

Medellin et al. U.S. Pat. No. 4,895,418 discloses a refreshment center that mounts on the inverted water bottle. This refreshment center consists of a compartmentalized box which extends down over the water bottle and which may be fixed in position or which may rotate in carousel fashion around the water bottle. However, this refreshment center is difficult to employ and does nothing to lessen the utilitarian aspect of the appearance of the water dispenser.

What is needed is a water dispenser bottle cover that is easy to use, that has means for attaching accessory features, and that improves the appearance of the water dispenser itself.

SUMMARY OF THE INVENTION

A decorative cover is provided which easily fits over a water bottle mounted on a water dispenser. This cover provides a variably changeable decor that can fit different tastes and environments. Further, this cover includes accessory features such as a handle for easy removal of the cover, a cup dispenser, and a pouch for storing water delivery schedules, bills and the like.

The cover can be made in a wide variety of shapes, ranging from a simple cover shaped to fit the contours of the enclosed bottle, to more fanciful shapes such as a person's head, animal's head or a building design. Other decoration can easily be effected by the addition of a ruffle around the top seam of the cover, for example, or by the addition of a logo or picture.

The cover can be made with a pattern of holes in the material or with one or more viewing ports such that the level of water can be ascertained. The holes or ports are also useful for increasing the amount of air circulation around the bottle, which in turn reduces the amount of condensation that may accumulate on the outside of the bottle and which may contribute to the growth of fungi or bacteria. The ports may also be covered up with removable flaps attachable by fasteners such as "Velcro," if desired.

The accessory features can be fastened to the cover by permanent means, such as by sewing, or by removable means, such as by "Velcro"-type or snap fasteners.

The cover can be made out of a variety of materials, including cotton or nylon fabric which may be washable and/or see-through, or a rigid material such as foam rubber coated with a plastic designed for writing and erasing messages, or a magnetic material upon which messages or notes can be attached. In addition, the cover may incorporate an inner liner of material having wicking qualities, to further prevent the buildup of condensation.

THE PREFERRED EMBODIMENT

Figure 1:
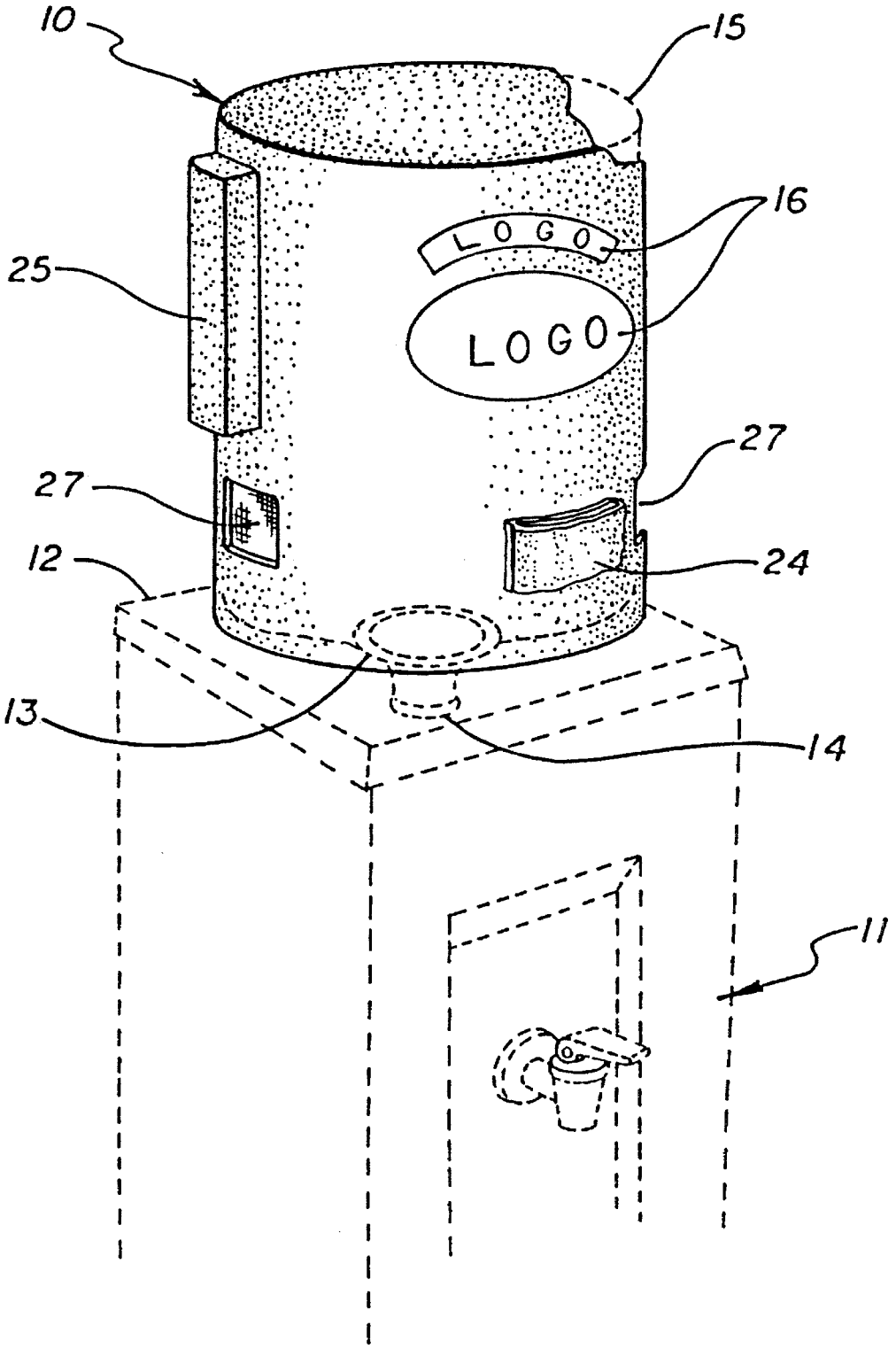
FIG. 1 is a front view of a water dispenser embodying the invention.

FIG. 1 shows the preferred embodiment of the water dispenser bottle cover 10 of the present invention in association with a conventional water dispenser 11 (shown in phantom lines). The water dispenser 11 has a top ledge 12 with an opening 13 for receiving the neck portion 14 of the water bottle 15 (shown in phantom lines) thereinto in a stably supported position by reason of gravity for holding the water bottle 15 until its water contents are dispensed, and a newly filled substitute bottle is replaced into the opening 13. The neck portion 14 of the water bottle 15 thus extends downwardly within the water dispenser in the dispensing position with the water bottle 15 extending upwardly as a visible towerlike structure on the ledge The bottle cover 10 is slidably mounted onto the water bottle, loosely surrounds the water bottle 15 and visibly encompasses the portion of the water bottle 15 extending upwardly from the ledge 12. The bottle cover 10 terminates in its open end to attain a position about and adjacent to a lower extremity of the circumference of the water bottle 15.

Figure 2:
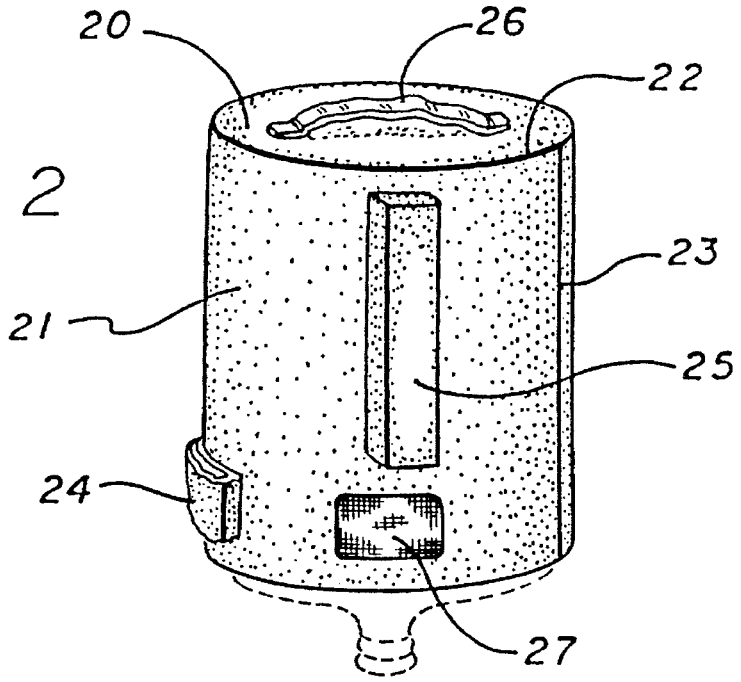
FIG. 2 is a side view showing a viewing port, cup holder and handle in one embodiment of the invention.

The bottle cover 10 (in this embodiment) is constructed from two pieces, namely the top circular panel 20 and the rectangular side panel 21 as shown in FIG. 2. These two pieces are stitched or otherwise affixed together at a seam 22 around the upper periphery of the water bottle 15, and at a longitudinal seam 23 that extends vertically up the side of the the water bottle 15, to form the cylindrical bottle cover of appropriate dimensions to loosely surround the water bottle 15. From its front view, the bottle cover 10 may carry a logo or decorative design 16, best seen in FIG. 1.

The decoration of the bottle cover 10 may be made to match the aesthetic tastes of the user. The bottle cover 10 can be made simply in the shape of the water bottle 15 in fabric having attractive colors, possibly with the addition of ruffles or other decorative features, or can be made in more fanciful shapes such as a person's likeness, an animal's head or the shape of a building. The logo or design 16 may be an advertisement, and the ease of construction and low cost of this bottle cover is such that it might be provided by the water company that provides the water bottles.

Figure 4:
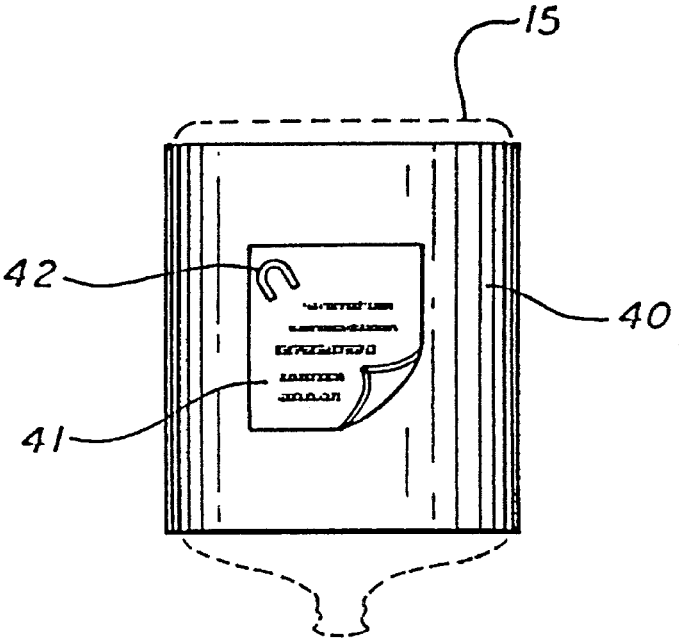
FIG. 4 is a front view of a rigid embodiment of the invention.

The material of the bottle cover 10 may be simple cotton fabric or quilting material, or may be constructed out of more rigid materials. Examples of such rigid materials are a metallic surface 40 such as illustrated in FIG. 4 onto which messages 41 can be affixed by magnetic means 42, or a surface that is sufficiently impermeable so that messages may be written and erased upon it (for example, commercially available whiteboard). When a rigid material is used for the bottle cover, a top is not necessary because the rigid material essentially forms a tube which will stand freely about the bottle, resting on the water dispenser. This embodiment of the bottle cover can be constructed of a single sheet of the rigid material coupled together at its ends forming a circular tube. Alternatively, this embodiment could be constructed of one or more sheets of rigid material formed into a rectangular shaped tube for fitting around a rectangular shaped water bottle. Additionally, a combination of rigid and non-rigid material could be used to construct the bottle cover.

FIGS. 1 and 2 show a variety of useful accessory features available to enhance the usefulness of the bottle cover 10. A pouch 24 can be put on the front or side portion of the bottle cover 10 to hold water delivery schedules, bills and other objects. It can be fastened by sewing or by some other type of fastening means, such as snaps or a "Velcro"-type fastener. It can be constructed of material similar to that of the bottle cover itself, or can be made of Nylon mesh.

A cup dispenser 25 can also be sewn or otherwise affixed onto any side surface of the bottle cover 10. The dispenser 25 can be made large enough to closely encompass a cup dispenser box, or can simply encompass the cups themselves. The dispenser 25 can be made in several different sizes to accomodate different sizes of cups, and can be made to be interchangeable by utilizing nonpermanent fastening means such as snaps or "Velcro"-type fasteners.

A handle 26 can be affixed to the top or side of the bottle cover 10 if desired, to facilitate the removal of the bottle cover 10 from the water bottle 15. The handle can be made to be removable by utilizing nonpermanent fastening means such as snaps or "Velcro"-type fasteners.

Viewing ports 27 can also be added to the bottle cover which are useful for two reasons. First, the water bottle 15 is generally kept at room temperature, where sweating or condensation can occur with changes in environmental temperature or humidity conditions. Such condensation, when it occurs, is undesirable since it can cause dripping from the water bottle 15 down into the water dispenser 11, thereby possibly contaminating the potable water. Condensation is also undesirable because a cloth bottle cover may absorb water and remain wet for a long period of time, leading to the accumulation of dirt and the proliferation of fungi or bacteria. Therefore, it is preferable that the bottle cover 10 be constructed with one or more holes or viewing ports 27 in the material such that air may circulate around the water bottle 15 and reduce or eliminate condensation. The viewing ports 27 also serve the function of allowing the user to monitor the level of water in the water bottle 15. To allow for maximum air flow and viewability, while preserving the structural integrity of the bottle cover 10, it is preferable that the port be contructed of Nylon mesh material, although no material at all may be used. The viewing ports 27 may be positioned anywhere on the bottle cover 10.

Figure 3:
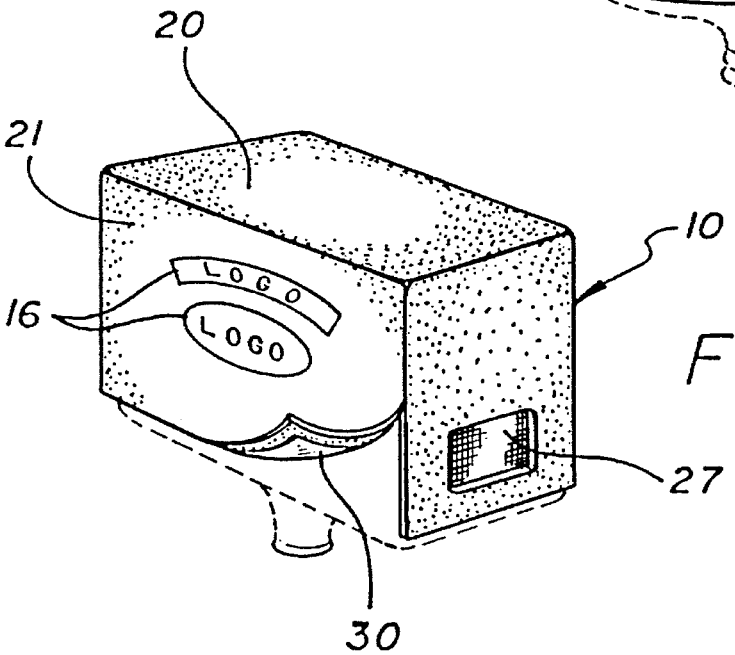
FIG. 3 is a front view of a rectangular embodiment of the invention.

Another way to control condensation is the addition of an inner liner 30 to the bottle cover 10 as shown in FIG. 3. The inner liner 30 can be constructed of a material with absorbant qualities that can wick moisture away from the water bottle 15. In the preferred embodiment of the present invention the inner liner 30 is constructed of a Nylon material. This liner can be made to be removable for ease of cleaning.

Improvements and modifications which become apparent to persons of ordinary skill in the art only after reading this disclosure, the drawings and the appended claims are deemed within the spirit and scope of the present invention.

What is claimed is:

1. A loose-fitting cover for covering and improving an appearance of a water bottle mounted on a water dispenser, comprising:

a. a top portion for covering an upper surface of the water bottle and keeping the cover positioned on the water bottle, the top portion having a first exterior side and a first interior side; and b. a first side portion coupled to the top portion for loosely covering sides of the water bottle, the side portion having a second exterior side and a second interior side.

2. The cover of claim 1 further comprising a handle coupled to the top portion for use in removing the cover from the dispenser.

3. The cover of claim 2 wherein the handle is coupled to the cover by a "Velcro"-type fastener.

4. The cover of claim 1 further comprising a cup dispenser coupled to the second exterior side of the cover for storing and dispensing cups.

5. The cover of claim 4 wherein the cup dispenser is coupled to the second exterior side of the cover by a "Velcro"-type fastener.

6. The cover of claim 1 further comprising a pouch coupled to the second exterior side of the cover for storing objects.

7. The cover of claim 1 wherein the first side portion is constructed of a rigid material.

8. The cover of claim 7 wherein the rigid material comprises a surface of sufficient impermeable characteristics for writing an erasable message thereon.

9. The cover of claim 7 wherein the rigid material is metallic for attaching messages by magnetic means.

10. The cover of claim 1 wherein the first side portion further comprises a plurality of viewing ports.

11. The cover of claim 10 wherein the viewing ports are constructed of Nylon mesh material.

12. The cover of claim 1 further comprising an interior lining coupled to the first and second interior sides for absorbing moisture away from the water bottle.

13. A water dispensing system comprising:

a. a water bottle having outer dimensions and predetermined shape and having a neck portion opening into an outlet spout extending from one end of the water bottle;

b. a water dispenser having a top ledge with an opening for receiving the neck of the water bottle thereinto in a stable storage position with the neck extending downwardly within the dispenser and the water bottle extending upwardly as a visible towerlike structure on the ledge; and c. a loose-fitting cover for covering and improving an appearance of the water bottle mounted on the water dispenser, comprising:

i) a top portion for covering an upper surface of the water bottle and keeping the cover positioned on the water bottle; and ii) a side portion coupled to the top portion for covering sides of the water bottle.

14. A cover for covering and improving an appearance of a water bottle mounted on a water dispenser, comprising a rigid free-standing tube having a diameter larger than a base of the water bottle and smaller than the water dispenser, wherein the cover will loosely slide over the water bottle for covering sides of the water bottle, the tube including a first exterior side and a first interior side.

15. The cover of claim 14 wherein the rigid material comprises a surface of sufficient impermeable characteristics for writing an erasable message thereon.

16. The cover of claim 14 wherein the rigid material is metallic for attaching messages by magnetic means.

17. The cover of claim 14 further comprising a top portion coupled to the rigid free-standing tube.

18. A cover for covering and improving an appearance of a water bottle mounted on a water dispenser wherein the cover is slidably mounted onto the water bottle, comprising:

a. a top portion for covering an upper surface of the water bottle and keeping the cover positioned on the water bottle, the top portion having a first exterior side and a first interior side;

b. a side portion coupled to the top portion for loosely covering sides of the water bottle, the side portion having a second exterior side and a second interior side;

c. a handle coupled to the cover for use in removing the cover from the water dispenser;

d. a cup dispenser coupled to the first exterior side of the cover for storing and dispensing cups; and e. a pouch coupled to the second exterior side of the cover for storing objects.

19. The cover of claim 18 further comprising a plurality of viewing ports.

20. The cover of claim 19 further comprising an interior lining coupled to the first and second interior sides for absorbing moisture away from the water bottle.

* * * * *

UNITED STATES PATENT AND TRADEMARK OFFICE

CERTIFICATE OF CORRECTION

PATENT NO. : 5,454,492

DATED : 10/3/95

INVENTOR(S) : Hunter et al.

It is certified that error appears in the above-identified patent and that said Letters Patent is hereby corrected as shown below:

In column 3, line 3, after "dispenser" and before "in" please insert --11--.

In column 3, line 5, after "ledge" please insert --12.--.

Signed and Sealed this

Twenty-eighth Day of November 1995

*Attest:*

*Attesting Officer*

Bruce Lehman

BRUCE LEHMAN

*Commissioner of Patents and Trademarks*